United States Patent [19]

Blough

[11] Patent Number: 4,633,697

[45] Date of Patent: Jan. 6, 1987

[54] PLATE LEVELLING MACHINE

[75] Inventor: Leonard P. Blough, Irwin, Pa.

[73] Assignee: Mesta Engineering Company, Pittsburgh, Pa.

[21] Appl. No.: 766,890

[22] Filed: Aug. 16, 1985

[51] Int. Cl.[4] ..... B21D 1/02

[52] U.S. Cl. ..... 72/164

[58] Field of Search ..... 72/160, 161, 163–165

[56] References Cited

U.S. PATENT DOCUMENTS

| | | | |
|---|---|---|---|
| 2,132,426 | 10/1938 | Maussnest | 72/163 |
| 2,578,820 | 12/1951 | Mayer | 72/165 |
| 2,852,065 | 9/1958 | Peterson . | |
| 2,944,585 | 7/1960 | Ungerer . | |
| 3,260,093 | 7/1966 | Polakowski . | |
| 3,605,470 | 9/1971 | Polakowski | 72/163 |
| 3,606,784 | 9/1971 | Schluter . | |
| 3,648,504 | 3/1972 | Schoffmann . | |
| 3,701,274 | 10/1972 | Roesch | 72/165 |
| 3,834,202 | 9/1974 | Kawaguchi et al. | 72/163 |

FOREIGN PATENT DOCUMENTS

| | | | |
|---|---|---|---|
| 11727 | 1/1982 | Japan | 72/165 |
| 1206018 | 9/1970 | United Kingdom | 72/164 |

*Primary Examiner*—Daniel C. Crane

*Attorney, Agent, or Firm*—Fred Wiviott

[57] ABSTRACT

A plate levelling machine includes a first group of small rolls and a second group of larger rolls connected in tandem with the rolls of the first group. The upper rolls of both groups are supported and arranged so that each group can be displaced away from their associated lower rolls while maintaining the rolls of the other group in an operative position. When light gauge plates are to be levelled, the larger upper rolls are displaced to an inactive position and the material is levelled using the small rolls. For heavier gauge material, the small rolls are moved out of position and the larger rolls are employed.

17 Claims, 4 Drawing Figures

PLATE LEVELLING MACHINE

BACKGROUND OF THE INVENTION

This invention relates to a plate leveller and more particularly to a plate leveller capable of levelling both light and heavy gauge plates.

Prior art plate levelling machines include a series of upper and lower banks of rolls arranged in a staggered relation to each other. The lower rolls are arranged generally tangentially to the path of material travel called the pass line. The upper rolls are arranged such that their distance from the pass line increases from the entry to the discharge sections. As the plate to be flattened is passed through prior art machines, it is initially distorted into a wave shaped configuration in the entry section. The magnitudes of the waves are gradually reduced as the plate passes through the machine so that it emerges from the delivery section in a flattened state. In the design of prior art machines, the roll diameter and spacing was selected to permit sufficient deflection of the product to produce a stress equal to the material yield strength through up to 85% of the plate thickness. The thickness range capability of prior art levelling machines was generally limited by constraints of selected roll diameter, spacing and load-carrying capability. In particular, small diameter relatively closely spaced rolls are required to process light gauge product. On the other hand, heavy gauge product requires relatively larger and more widely spaced rolls.

SUMMARY OF THE INVENTION

It is an object of the invention to provide a new and improved plate levelling machine.

Another object of the invention is to provide a plate levelling machine in which light, intermediate and heavy gauge plates can be processed.

A further object of the invention is to provide a levelling machine in which plates of widely different gauges can be levelled without the necessity to change roll sizes.

These and other objects and advantages of the present invention will become more apparent from the detailed description thereof taken with the accompanying drawings.

In general terms, the invention comprises a levelling machine having a first group of relatively smaller lower rolls and a second group of relatively larger lower rolls all arranged along a pass line. A first group of relatively small upper rolls and a second group of relatively larger upper rolls are supported on a frame above the pass line. Means are provided for orienting the frame in a first mode whereby the relatively small upper rolls are located in an operative position adjacent the pass line and the relatively larger upper rolls are located in an inoperative position displaced from the relatively larger upper rolls and for orienting the frame in a second mode whereby the relatively small upper rolls are located in an inoperative position displaced from the pass line and the relatively larger upper rolls are located in an operative position opposed to the relatively larger lower rolls.

DETAILED DESCRIPTION OF THE PREFERRED EMBODIMENT

Figure 1:
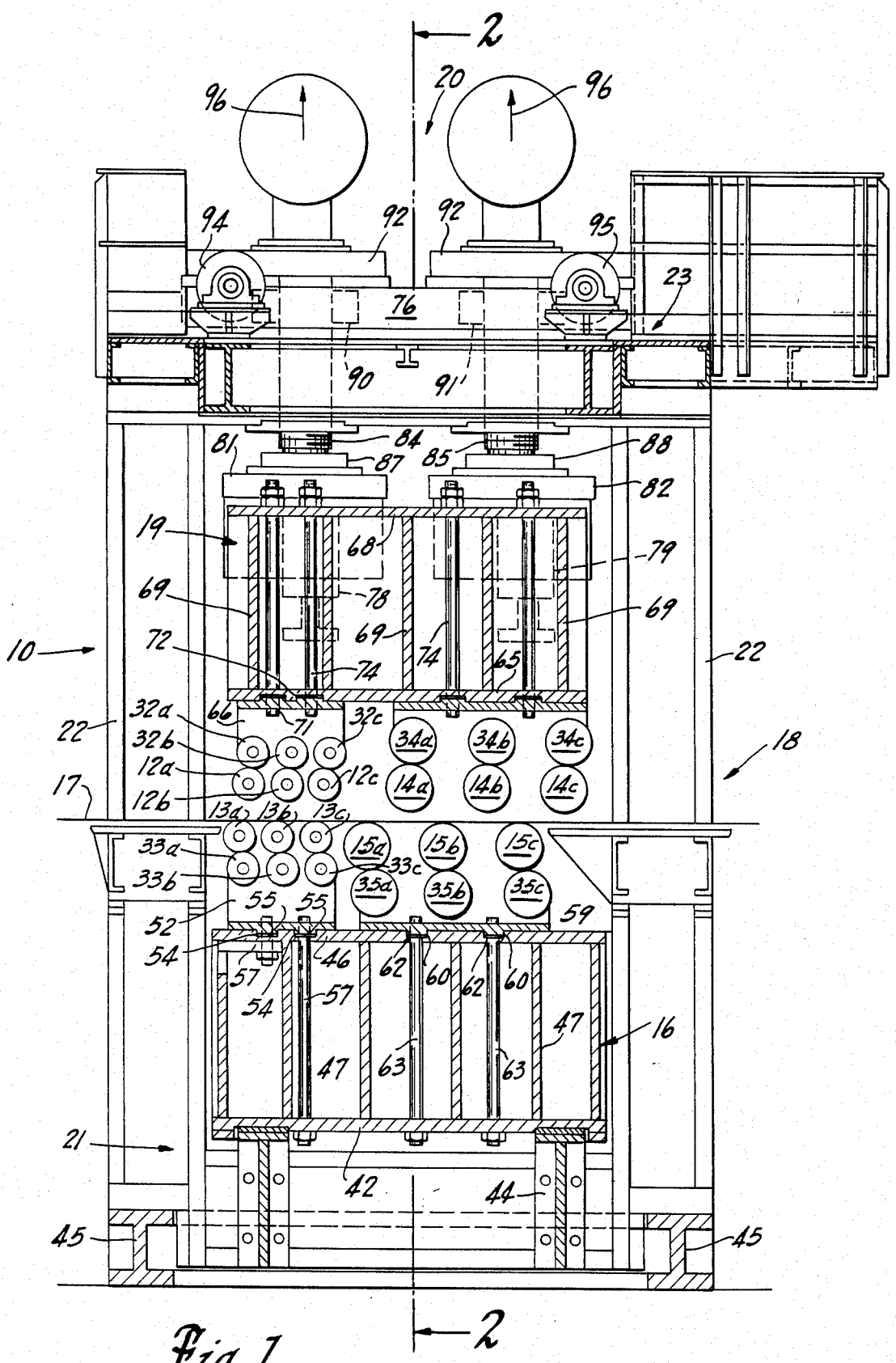
FIG. 1 is an end view, partly in section of the preferred embodiment of the invention.
Figure 2:
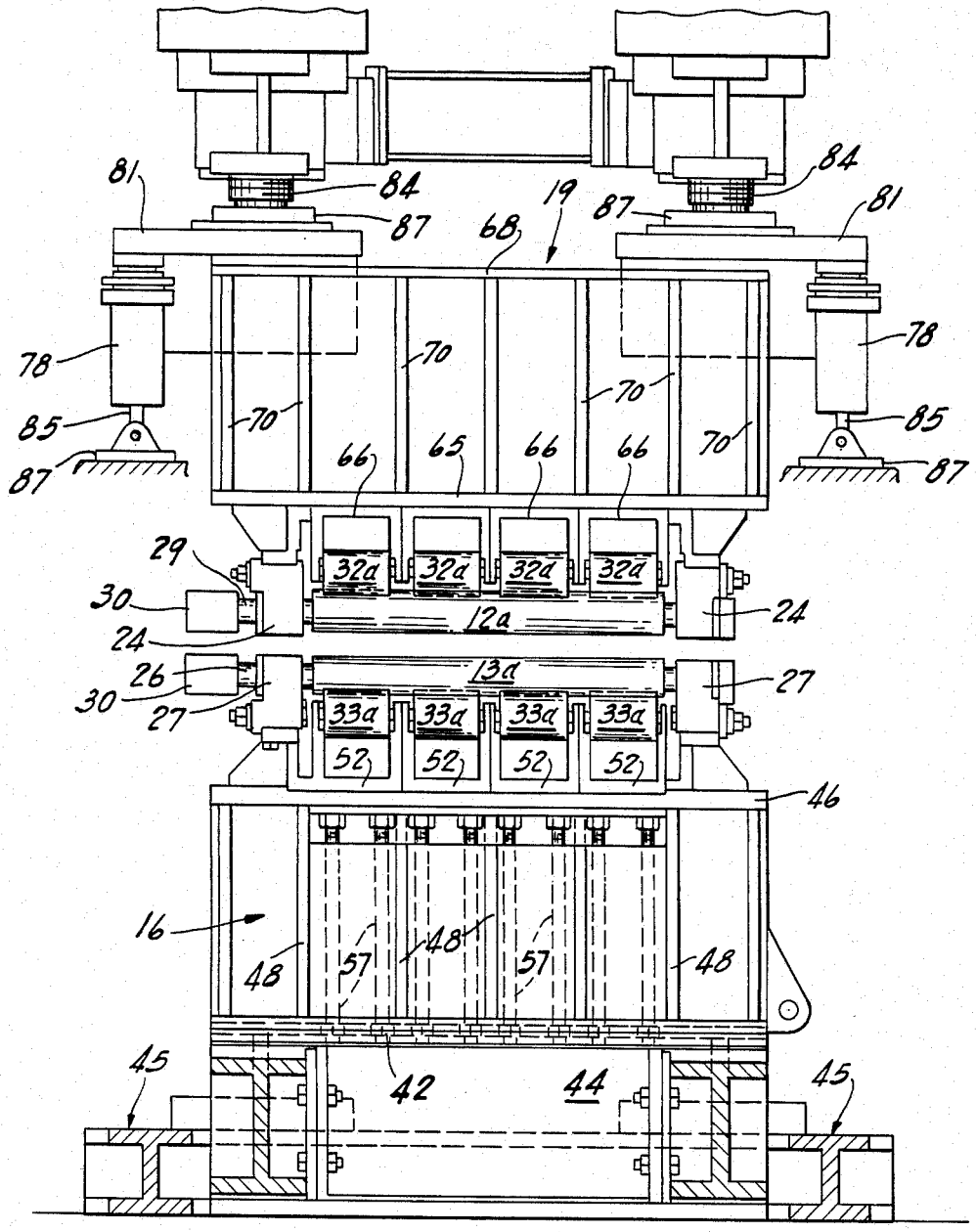
FIG. 2 is a view taken along lines 2—2 of FIG. 1.

FIGS. 1 and 2 show the levelling machine 10 in accordance with the preferred embodiment of the invention to include a first group of upper levelling rolls 12 consisting of rolls 12*a*, 12*b* and 12*c* and cooperating lower levelling rolls 13 consisting of rolls 13*a*, 13*b* and 13*c*. There are, in addition, a second group of relatively larger upper levelling rolls 14 consisting of rolls 14*a*, 14*b* and 14*c* and a cooperating group of lower levelling rolls 15 consisting of rolls 15*a*, 15*b* and 15*c*. The lower rolls 13 and 15 are rotatably mounted in a parallel spaced apart relation on a lower frame 16 and are positioned such that all are adjacent the path of material travel, called the pass line 17. The lower frame 16 is, in turn, mounted on the machine's main frame 18. The upper rolls 12 and 14 are rotatably mounted in a parallel spaced apart relation to each other and in general parallel with the lower rolls 13 and 15 on the upper frame 19. As will be discussed more specifically below, the frame 19 is mounted on a positioning assembly 20 which is operative to tilt the frame 19 through small angles about an axis perpendicular to FIG. 1 so that either the group of small rolls 12 or the group of large rolls 14 will be moved away from the pass line 17.

The main frame 18 is conventional and generally includes a base portion 21 which supports the lower frame 16, side portions 22 extending upwardly from the base portion 21 and an upper portion 23 mounted atop the side portions 22.

All of the upper and lower levelling rolls are mounted in a similar manner so that only rolls 12*a* and 13*a* will be discussed in detail. The upper roll 12*a* has shafts 29 extending from its opposite ends and which are rotatably supported in bearings 24 mounted in a spaced apart, coaxial relation on upper frame 19. The lower roll 13*a* also has shafts 26 which are rotatably supported by bearings 27 mounted in a spaced apart coaxial relation on the lower frame 16. A spindle (not shown) is disposed at the end of each shaft 26 and 29 and and is coupled through a coupling 30 to a pinion stand (not shown) which is in turn driven by a speed reducer (not shown) and by a D.C. motor (not shown) in a manner well known in the art. While only rolls 12*a* and 13*a* are shown in FIG. 2, it will be appreciated that each of the other rolls 12*b*, 12*c*, 13*b*, 13*c*, 14*a*, 14*b*, 14*c*, 15*a*, 15*b* and 15*c* are all supported and driven in a like manner.

Sets of backing rolls 32 and 34 comprising respectively rolls 32*a*, 32*b*, 32*c* and 34*a*, 34*b* and 34*c* are rotatably mounted on frame 19 in engagement respectively with the rolls 12 and 14. Similarly, the backing rolls 33 and 35 comprising respectively rolls 33*a*, 33*b*, 33*c* and 35*a*, 35*b*, 35*c* are rotatably mounted on the lower frame 16 and disposed in engagement with respective ones of the rolls 13 and 15. Those skilled in the art will appreciate the backing rolls provide support and stiffness to the various levelling rolls.

The base portion 21 of the main support frame 18 includes a base plate 42 mounted on a subframe 44 which is suitably anchored to support rails 45. A top plate 46 is suitably supported in a parallel spaced relation above the base plate 42 by means of vertical plates 47 and ribs 48. The bearings 27 are mounted adjacent the opposite sides of the top plate 46. It will be understood that corresponding bearings for each of the rolls 13*b*, 13*c*, 15*a*, 15*b* and 15*c* are similarly mounted on plate 46. The backing rolls 33*a*, 33*b* and 33*c* are mounted in alignment below their associated levelling rolls by means of a plurality of generally U-shaped supports 52 mounted on the top plate 46, More specifically, a first pair of grooves 54 are formed in the upper surface of the top plate 46 and below and in generaly parallelism with the axes of rolls 13*a*, 13*b* and 13*c*. The supports 52 each have a pair of tongues 55 which are complimentary with and received in the grooves 54. The supports 52 may be secured to plate 46 in a side-by-side relation in any suitable manner, such as by bolts 57 which extend through aligned openings in the base plate 42 and the top plate 46 and are received within threaded holes in the supports 52. The backing rolls 35*a*, 35*b* and 35*c* for the rolls 15*a*, 15*b* and 15*c* are each mounted on one of a plurality of u-shaped supports 59 which are mounted on the top plate 46 in a similar manner by grooves 60, tongues 62 and bolts 63.

The upper frame 19 is similar to the lower frame 16 and includes a bottom plate 65 which supports the bearings 24 for each of the upper levelling rolls 12 and 14 and supports 66 for their respective backing rolls 32 and 34. The bottom plate 65 is supported from a top plate 68 by means of a plurality of stiffening plates 69 and ribs 70. Each support 66 includes a tongue 71 received in an elongate groove 72 formed in plate 65 and secured therein by means of bolts 74.

As indicated above, the upper frame 19 is supported so that either the smaller diameter rolls 12 or the larger diameter rolls 14 may be elevated relative to the pass line 17. This is accomplished by the positioning assembly 20 which includes a drive mechanism 76 and hydraulic support cylinders 78 and 79. More particularly, each end of the frame 19 is secured to and supported beneath a pair of carrier plates 81 or 82, the carrier plates of each pair being spaced from each other and from the other pair. This places a carrier plate 81 or 82 above each corner of the frame 19. The carrier plates 81 and 82 extend outwardly from the lateral sides of the frame 18 and each is supported by the upper end of one of a vertically oriented and downwardly extending hydraulic cylinders 78 or 79. Projecting downwardly from each cylinder 78 and 79 is a rod 85 which is pivotally connected at its lower end to a support 87 fixed to the side portion 22 of the main frame 18. The lower end of each cylinder 78 and 79 is connected to a hydraulic accumulator (not shown) so that the weight of the upper frame 19 and the rolls 12 and 14 are counterbalanced.

The carrier plates 81 and 82 are each coupled respectively to a vertically extending screw shaft 84 and 85 which form a part of the drive mechanism 76. More specifically, thrust bearings 87 and 88 are mounted respectively on the upper surfaces of the carrier plates 81 and 82 for rotatably receiving the lower ends of the screw shafts 84 and 85. The upper end of each screw shaft 84 and 85 is threadably received in a nut 90 or 91 rotatably mounted within housings 92 supported on the upper frame portion 23. Each nut 90 and 91 may be rotated, respectively, by means of reversable motors 94 and 95 to which they are coupled by a separate gear drive (not shown). It will be appreciated that when the motors 94 are operated the end of the frame 19 upon which the upper rolls 12 are mounted, will be moved vertically and when the motors 95 are operated the end of the frame 19 upon which the upper rolls 14 are mounted will be moved vertically. It will also be appreciated that the same result can be obtained by rotating the screw shafts 84 and 85 and holding the nuts 90 and 91 stationary. Indicators 96 are coupled to the screw shafts 84 and 85 to indicate the position of each end of the frame 19 by showing the rotary position of each screw.

Figure 4:
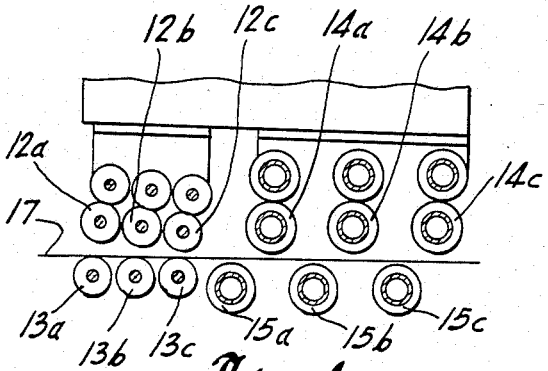
FIGS. 3 and 4 show the levelling machine according to the invention in its various operating modes.
Figure 3:
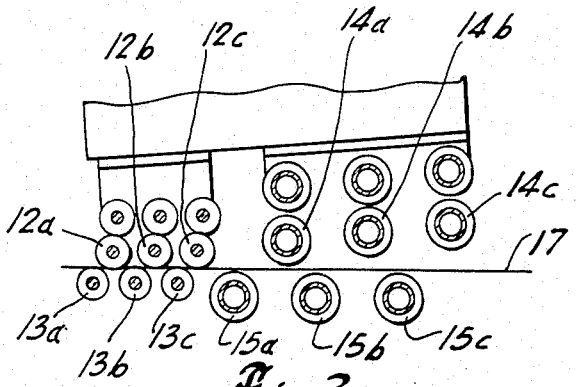

FIG. 3 shows the frame 19 and the rolls 12 and 14 positioned for levelling a relatively small gauge plate and FIG. 4 shows the rolls positioned for levelling a larger plate. In particular, for smaller gauge plates the motors 94 and 95 are operated so as to tilt the frame 19 such that the upper rolls 12 are adjacent the pass line 17 and the rolls 14 are displaced therefrom. As those skilled in the art will appreciate, the spacing between the upper rolls 12 and the pass line 17 will be determined by the thickness of the material being straightened and the contact stresses between the material and the rolls. With smaller gauge material, the spacing between the rolls 12 and 13 will be less than for relatively heavier gauge material. For levelling heavier gauge plates, the motors 94 and 95 are operated to tilt the frame 19 to its position shown in FIG. 4 wherein the relatively larger rolls 14 are positioned adjacent the pass line and the smaller rolls 12 are displaced therefrom. Again, the distance between the rolls 14 and 15 would be dictated by the thickness of the material being levelled and the contact stresses.

As with conventional machines, the plate to be flattened initially enters between rolls 12*a* or 13*a* in the case of lighter gauge material or rollers 14*a* and 15*a* if for heavier gauge plates. As the plate passes the initial rolls, it is distorted into a wave shape. These waves are reduced gradually as the plate passes through the machine so that it emerges from the last rolls 12*c* and 13*c* or 14*c* and 15*c* in a flattened condition.

While only a single embodiment of the invention has been illustrated and described, it is not intended to be limited thereby but only by the scope of the appended claims.

I claim:

1. A levelling machine for levelling a metallic product and having a first frame means, a first group of relatively small lower rolls and a second group of relatively larger lower rolls all mounted on said first frame means and oriented along a pass line which defines the path of the product through said machine, a unitary second frame means disposed above said first frame means and mounted for movement relative to said first frame means, and said pass line, a first group of relatively small upper rolls and a second group of relatively larger upper rolls all mounted on said second frame means for movement therewith relative to said pass line, said small and large upper rolls being disposed in a staggered opposed relation respectively to the relatively small and larger lower rolls, the rolls of said groups of relatively larger lower and upper rolls being more widely spaced respectively than the rolls of said groups of relatively small lower and upper rolls, said second frame means being movable between first and second positions whereby when said second frame means is in said first position said relatively small upper rolls are located in an operative position opposed to said relatively small lower rolls and adjacent the pass line and said relatively larger upper rolls are located in an inoperative position displaced from the pass line and when said second frame means is in its second position said relatively small upper rolls are located in an inoperative position displaced from the pass line and the relatively larger upper rolls are located in an opposed relation to said relatively larger lower rolls and adjacent the pass line, and positioning means for selectively moving said second frame means between its first and second positions for moving said relatively small and larger rolls relative to the pass line so that product of different thickness can be levelled without removing and replacing said rolls.

2. The levelling machine set forth in claim 1 wherein said positioning means includes first and second threaded means coupled respectively to spaced apart portions of said second frame means, and drive means for selectively rotating said threaded means for moving said second frame means into and out of its first and second positions so that one of said groups of rolls is moved toward said pass line and the other group of rolls is moved away therefrom.

3. The levelling machine set forth in claim 2 and including hydraulic means for supporting said second frame means in each of its positions and as it is moved between positions.

4. The levelling machine set forth in claim 3 wherein said relatively small rolls are disposed on one side of said second frame means and said relatively larger rolls on the other side thereof, said first threaded means engaging the one side of said second frame means for moving the same vertically and the second threaded means engaging the other side of said second frame means for moving said other side vertically, the first and second hydraulic means supporting the first and second sides of said second frame means, respectively.

5. The levelling machine set forth in claim 1 wherein said relatively small upper rolls are disposed on one side of said second frame means and said relatively larger upper rolls on the other side thereof, first threaded means engaging the one side of said second frame for moving the same vertically and second threaded means engaging the other side of said second frame for moving said other side vertically.

6. The levelling machine set forth in claim 5 wherein said first frame means is stationary and supports said lower rolls for rotation about generally parallel horizontal axes, said threaded means being operative for tilting the second frame means relative to the first frame means so that the one of the groups of upper rolls may be moved toward the pass line and the other moved simultaneously away from the pass line.

7. The levelling machine set forth in claim 6 wherein the threaded means comprises first and second threaded screw shafts coupled to the opposite sides of the second frame means, first and second nut means threadably engaging the first and second screw shafts, respectively, and motor means for simultaneously rotating the first and second nut means or screw shaft means in opposite directions for tilting the second frame means.

8. The levelling machine set forth in claim 1 wherein said second frame means comprises upper frame means supporting the upper rolls and said first frame means comprises stationary lower frame means supporting said lower rolls for rotation about generally parallel horizontal axes, said positioning means being operative for tilting the upper frame means relative to the lower frame means so that one of the groups of relatively small and relatively larger upper rolls may be moved toward the pass line and the other moved simultaneously away from the pass line.

9. A levelling machine for levelling a metallic product moving in a path through said machine which defines a pass line, said machine having a first support , a first group of relatively small lower rolls and a second group of relatively larger lower rolls, said lower rolls each being elongate and mounted on said first support for rotation about generally parallel axes, a second support disposed above said first support, a first group of relatively small upper rolls and a second group of relatively larger upper rolls, said small and larger upper rolls being mounted on said second support in a staggered opposed relation, respectively, to the relatively small and larger lower rolls, the rolls of said groups of relatively larger lower and upper rolls being more widely spaced respectively than the rolls of said groups of relatively small lower and upper rolls, said upper rolls being mounted on said second support for rotation about axes which are parallel to each other and to the rotational axes of the lower rolls, said lower rolls being disposed adjacent said pass line, and adjusting means coupled to said second support for moving said second support to simultaneously and oppositely adjust the relative distance between each of the groups of upper rolls and said pass line so that when one of said group of upper rolls is moved into an operative position adjacent said pass line the other group of upper rolls is moved into an inoperative position away from said pass line

10. The levelling machine set forth in claim 9 wherein said adjusting means is operative to tilt said second support for simultaneously moving each of said upper rolls relative to said pass line whereby said relatively small and larger upper rolls will be moved respectively in opposite directions relative to said pass line.

11. The levelling machine set forth in claim 9 wherein said first support comprises lower frame means, said lower frame means being stationary and supporting said lower rolls for rotation about generally parallel horizontal axes, said positioning means being operative for tilting the upper frame means relative to the lower frame means so that the one group of upper rolls may be moved toward the pass line and the other group moved simultaneously away from the pass line.

12. The levelling machine set forth in claim 11 wherein said positioning means comprises threaded screw shafts coupled to the opposite sides of the upper frame means, nut means threadably engaging the screw shafts, respectively, and motor means for simlutaneously rotating the nut means or screw shaft means in opposite directions for tilting the upper frame means.

13. The levelling machine set forth in claim 12 and including hydraulic means for supporting said upper frame means.

14. A levelling machine for levelling a metallic product moving in a path through the machine which defines a pass line, said machine having a lower stationary frame means, a first group of relatively small lower rolls and a second group of relatively larger lower rolls, said lower rollers each being elongate and mounted on said lower frame means for rotation about generally parallel axes and disposed adjacent the pass line, an upper frame means disposed above said lower frame means, a first group of relatively small upper rolls and a second group of relatively larger upper rolls each rotatably mounted on the upper frame means for rotation about axes parallel to the rotational axes of the lower rolls, said small and large upper rolls being disposed in a staggered opposed relation respectively to the relatively small and larger lower rolls, and adjusting means coupled to the upper frame means and being operative for moving the upper frame means relative to the lower frame means so that the relatively larger upper rolls or the relatively smaller upper rolls may selectively be moved toward said pass line and the other simultaneously moved away therefrom.

15. The levelling machine set forth in claim 14 and said adjusting means being operative for tilting the upper frame means relative to the lower frame means so that the upper rolls may be moved simultaneously either toward or away from the pass line.

16. A levelling machine for levelling a metallic product moving in a path through the machine and which defines a pass line, said machine having a lower stationary frame means, a first group of relatively small lower rolls and a second group of relatively larger lower rolls, said lower rollers each being elongate and mounted on said lower frame means for rotation about generally parallel axes and disposed adjacent the pass line, an upper frame means, a first group of relatively small upper rolls and a second group of relatively larger upper rolls each rotatably mounted on the upper frame means for rotation about axes parallel to the rotational axes of the lower rolls, said small and large upper rolls being disposed in a staggered opposed relation respectively to the relatively small and larger lower rolls, said small and large upper rolls being disposed in a staggered opposed relation respectively to the relatively small and larger lower rolls, adjusting means coupled to the upper frame means and being operative for tilting the upper frame means relative to the lower frame means so that the relatively larger upper rolls or the relatively smaller lower rolls may selectively be moved toward the pass line and the other simultaneously moved away therefrom, said relatively small upper rolls being disposed on one side of said upper frame means and said relatively larger upper rolls being disposed on the other side thereof, said adjusting means engaging the one and other sides of said upper frame means for tilting the same relative to said pass line for moving said small and larger upper rolls relative to the pass line and in opposite directions.

17. The levelling machine set forth in claim 16 and including hydraulic means for supporting said upper frame means.

* * * * *